US006615757B2

(12) United States Patent
Ochi

(10) Patent No.: US 6,615,757 B2
(45) Date of Patent: Sep. 9, 2003

(54) OVER LOCK SEWING MACHINE

(75) Inventor: Moriya Ochi, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/867,448

(22) Filed: May 31, 2001

(65) Prior Publication Data

US 2002/0017227 A1 Feb. 14, 2002

(30) Foreign Application Priority Data

May 31, 2000 (JP) ..... 2000-163101

(51) Int. Cl.[7] ..... D05B 1/10; D05B 1/14

(52) U.S. Cl. ..... 112/443; 112/162; 112/165

(58) Field of Search ..... 112/443, 165, 112/167, 464, 455, 449, 162, 197, 160, 161, 166, 176, 177, 199, 200, 157, 451, 452, 467

(56) References Cited

U.S. PATENT DOCUMENTS 1,223,564 A * 4/1917 Cornely ..... 112/81
2,329,681 A * 9/1943 Zeier ..... 112/221
2,396,169 A * 3/1946 Fredericks ..... 112/159
3,313,258 A * 4/1967 Wulbrede et al. ..... 112/443
4,858,548 A * 8/1989 Echeverria ..... 112/220
4,873,932 A * 10/1989 Adams ..... 112/220
4,970,976 A * 11/1990 Kitai et al. ..... 112/162
5,099,776 A * 3/1992 Jimenez et al. ..... 112/221
6,058,862 A * 5/2000 Umeda et al. ..... 112/443
6,070,541 A 6/2000 Kinoshita et al.

FOREIGN PATENT DOCUMENTS

TW 87215808 9/1999

* cited by examiner

*Primary Examiner*—Ismael Izaguirre
(74) *Attorney, Agent, or Firm*—Oblon, Spivak, McClelland, Maier & Neustadt, P.C.

(57) ABSTRACT

The over lock sewing machine for forming seams of an over-edge chain stitch and a double-thread chain stitch on a work cloth is provided with a needle bar holding a plurality of needles for forming a seam by a vertical reciprocating movement a plurality of loopers and a needle bar transmitting mechanism moving the needle bar in approximately orthogonal direction relative to a cloth feeding direction of the work cloth and the vertical reciprocating direction of the needle bar. Accordingly, the over lock sewing machine can make various decorative stitches with an over-edge chain stitch function and a zigzag stitch function. Moreover, the over lock sewing machine is capable with operation at a low cost.

5 Claims, 8 Drawing Sheets

OVER LOCK SEWING MACHINE

CROSS REFERENCE TO RELATED APPLICATIONS

The present application is based on Japanese Application 2000-163101, filed on May 31, 2000, which is hereby incorporated by reference in its entirety.

BACKGROUND OF THE INVENTION

1. Field of the Invention

This invention relates to an over lock sewing machine.

2. Discussion of the Background

Recently, a demand for a luxurious embroidery sewing machine has been increasing significantly according to a diversification of the individuals. In addition to a lock stitch sewing machine, a demand for an expansion of a zigzag decorative stitch type has been also increasing. Besides, as for an over lock sewing machine, a double-thread chain stitch bottom decoration function by a plurality of needles is added to comply with such demands. As a result, an application for making a decorative stitch with a seamy looper thread side has became popular.

In a general home sewing, the over lock sewing machine is suitable far a whipstitch but a zigzag stitch by the lock stitch sewing machine is substituted for the whipstitch instead of buying two different type sewing machines. In most cases, since a single lock stitch sewing machine is used for various purposes, a finish of stitching is inferior compared to that of a general clothing. Accordingly, in order to further improve the finish, it is general to purchase an over lock sewing machine as a second sewing machine taking account of a financial strain, a storage space, a work space, and a difficulty of an alternative usage. Further, in recent years, a knit material having large stretch has been used more and more. Accordingly, in a plain seam process, the finish of the double-thread chain stitch is superior to the finish of the lock stitch in most cases.

As a result, a technology which combines the functions of the lock stitch sewing machine and the over lock sewing machine has been developed. For instance, as a first conventional art, a sewing machine adding a lock stitch function to an over lock sewing machine is disclosed in a Japanese Patent Application published in 1996 as Toku Kai Hei 8-24451. The sewing machine is provided with a single needle bar and loopers and a shuttle body are positioned adjacent to each other.

As a second conventional art, a combined sewing machine is disclosed in a Japanese Patent Application published in 1981 as Toku Kai Sho 56-148378. The combined sewing machine is provided with an over lock function at a front surface of a leg portion of a lock stitch sewing machine. When in use of the over lock, the over lock function is moved to the lock stitch position.

As a third conventional art, a combined sewing machine is disclosed in a Japanese Patent Application published in 1979 as Toku Kai Sho 54-76347. The combined sewing machine is provided with an over lock function at a rearward of a leg portion of a lock stitch sewing machine. When in use of the over lock, the lock stitch sewing machine is inverted for using the over lock sewing machine.

However, the sewing machine in the first conventional art can make an over-edge chain stitch, a double-thread chain straight stitch, and a straight lock stitch but can not make a zigzag stitch. Various decorative stitches can not be achieved by the sewing machine. In the lock stitch sewing machine, the shuttle body is desirably positioned closest to a lower surface of a throat plate in order to assure the stitch function. In the conventional art, the shuttle body needs to be positioned lower than a bottom dead point of the over-edge chain needle in order to avoid the interference with the over-edge chain needle. Accordingly, the amount of the absorbing thread of the shuttle body is increased and the stitch function might be defected Further, in proportion to the position of the shuttle body, the lower end of the lock stitch needle is positioned lower than the over-edge chain needle. When the same, type needles are used, the lower end of the needle holder holding the upper end portion of the needles also has the same step and the pressure increasing amount is limited in response to the step. In order to assure the pressure increasing amount with the over-edge chain needle, a special long needle in response to the step as the lock stitch needle needs to be used. When the long needle is used, the defects caused by a needle bend might be generated. Further, the threading the looper arranged at the rearward of the shuttle body might be difficult.

Moreover, a stroke of a needle thread take ups taking up the absorbing thread amount of the shuttle body is increased. Besides the increased stroke, the increase of the moving members might be a factor of a noise and oscillation malfunction. Further, materials such as a shuttle body, a needle thread take ups, a stitch balancing thread tension, and a sewing machine guide member for forming a seam of a lock stitch need to be added independently. As a result, the cost might be increased drastically.

The sewing machine in the second conventional art can make a straight lock stitch, a zigzag lock stitch, an over-edge chain stitch, and a double-thread chain straight stitch, but can not make a double-thread chain zigzag stitch. Various decorative stitches can not be achieved by the sewing machine. Further, materials such as a shuttle body, a needle thread take ups, a stitch balancing thread tension, and a sewing machine guide member for forming a seam of a lock stitch need to be added independently. As a result, the cost might be increased drastically. Moreover, a driving changeover clutch for the lock stitch and the over-edge chain stitch is added and the cost might be increased drastically. Further, when the over-edge chain stitch is made, the cloth feeding might be difficult due to materials such as a pressure foot and needles for the lock stitch provided at the rearward.

The sewing machine in the third conventional art can also make a straight lock stitch, a zigzag lock stitch, an over-edge chain stitch, and a double-thread chain straight stitch, but can not make a double-thread chain zigzag stitch. Various decorative stitches can not he achieved by the sewing machine. Further, materials such as a shuttle body, a needle thread take ups, a stitch balancing thread tension, and a sewing machine guide member for forming a seam of a lock stitch need to be added independently. As a result, the cost might be increased drastically. Moreover, a driving changeover clutch for the lock stitch and the over-edge chain stitch is added and the cost might be increased drastically.

Further, when the over-edge chain stitch is made, the sewing machine is difficult to operate since the sewing machine needs to be inverted.

SUMMARY OF THE INVENTION

It is an object of the present invention to provide an over lock sewing machine which can make various decorative stitches with the over-edge chain stitch function and the zigzag stitch function and which is low in cost.

In order to solve above technical problems, an over lock sewing machine for forming seams of an over-edge chain stitch and a double-thread chain stitch on a work cloth is provided with a needle bar holding a plurality of needles for forming a seam by a vertical reciprocating movement, a plurality of loopers and a needle bar transmitting mechanism moving the needle bar in approximately orthogonal direction relative to a cloth feeding direction of the work cloth and the vertical reciprocating direction of the needle bar.

According to an aspect of the present invention, since the needle bar can be moved in approximately orthogonality direction to the cloth feeding direction of the work cloth and the vertical reciprocating direction of the needle bar by the needle bar transmitting mechanism, the over lock sewing machine can make various decorative stitches with the over-edge chain stitch function and the zigzag stitch function. By only providing the needle bar transmitting mechanism, various decorative stitches can be realized. Accordingly, the over lock sewing machine can make various decorative stitches. The over lock sewing machine capable with operation as well as the conventional one can be obtained at a low cost.

In order to solve above technical problems, the over lock sewing machine is provided with the needle bar transmitting mechanism including an approximately T shaped needle bar holder having an approximately vertical portion vertically reciprocably supporting the needle bar at both end areas and an approximately horizontal portion extending perpendicularly from the middle of the vertical portion, a rack provided in parallel with the extending direction of the horizontal portion, and a worm connected with a rotating drive device fixed to a sewing machine frame and being in meshing engagement with the rack. The approximately horizontal portion of the over lock sewing machine is provided with a holding device being in parallel with the moving direction of the needle bar by the needle bar transmitting mechanism for slidably supporting a guide shaft fixed to the sewing machine frame at both end areas of the guide shaft.

According to another aspect of the present invention, the needle bar is vertically reciprocatably supported by the approximately vertical portion of the needle bar holder and the approximately horizontal portion can reciprocate in horizontal direction by the worm and the rack mechanism. Accordingly, since the needle bar transmitting mechanism can be configured with simple and compact structure, the over lock sewing machine can be obtained at a low cost. Further, since the needle bar can always be vertically reciprocatably perpendicularly supported by the approximately vertical portion, the generation of defects such as a stitch skipping and a thread breakage caused by a needle bend can be prevented.

In order to solve above technical problems, the over lock sewing machine is provided with the holding device including a plurality of boss portions extending from the both end areas of the horizontal portion and having a corresponding number of horizontal holes each having a common central axis extending in horizontally extended direction of the horizontal portion, a corresponding number of bushes for the guide shift inserted into the horizontal holes, and the guide shaft supported by the bushed, said holding device further includes a plurality of boss portions extending from the both end areas of the vertical portion and having a corresponding number of vertical holes each having a common central axis extending in vertically extended direction of the vertical portion, a corresponding number of bushes for the needle bar inserted into the vertical holes, and the needle bar vertically reciprocably supported by the bushels for the needle bar and wherein the horizontal holes and the bushes fur the guide shaft are adhered together and the vertical holes and the bushes for the needle bar are adhered together.

According to still another aspect of the present invention, the guide shaft bushes and the needle bar bushes can be adhered to the needle holder with keeping the perpendicularity therebetween by a tool. Accordingly, since the high accuracy to manufacture the needle bar holder is not needed, the needle bar holder can be manufactured at a low cost.

According to an aspect of the present invention, the over lock sewing machine is provided with the needle bar transmitting mechanism moving the needle bar in approximately orthogonality direction to the cloth feeding direction of the work cloth and the vertical reciprocating direction of the needle bar. The needle bar being synchronized with the movement of the loopers can move in approximately orthogonality right and left direction to the cloth feeding direction of the work cloth and the vertical reciprocating direction of the needle bar. Accordingly, the over lock sewing machine can realize the over-edge chain stitch function and the zigzag stitch function.

Accordingly, with a single sewing machine, a double-thread chain zigzag stitch as a substitution for a lock stitch sewing machine, and a decorative stitch as well as a zigzag decorative stitch type of the lock stitch sewing machine can be achieved besides an over-edge chain stitch. Further, an optimal stitch type for a kit material can be achieved. In this manner, high completion of home sewing can be realized for solving above technical problems.

BRIEF DESCRIPTION OF THE DRAWINGS

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
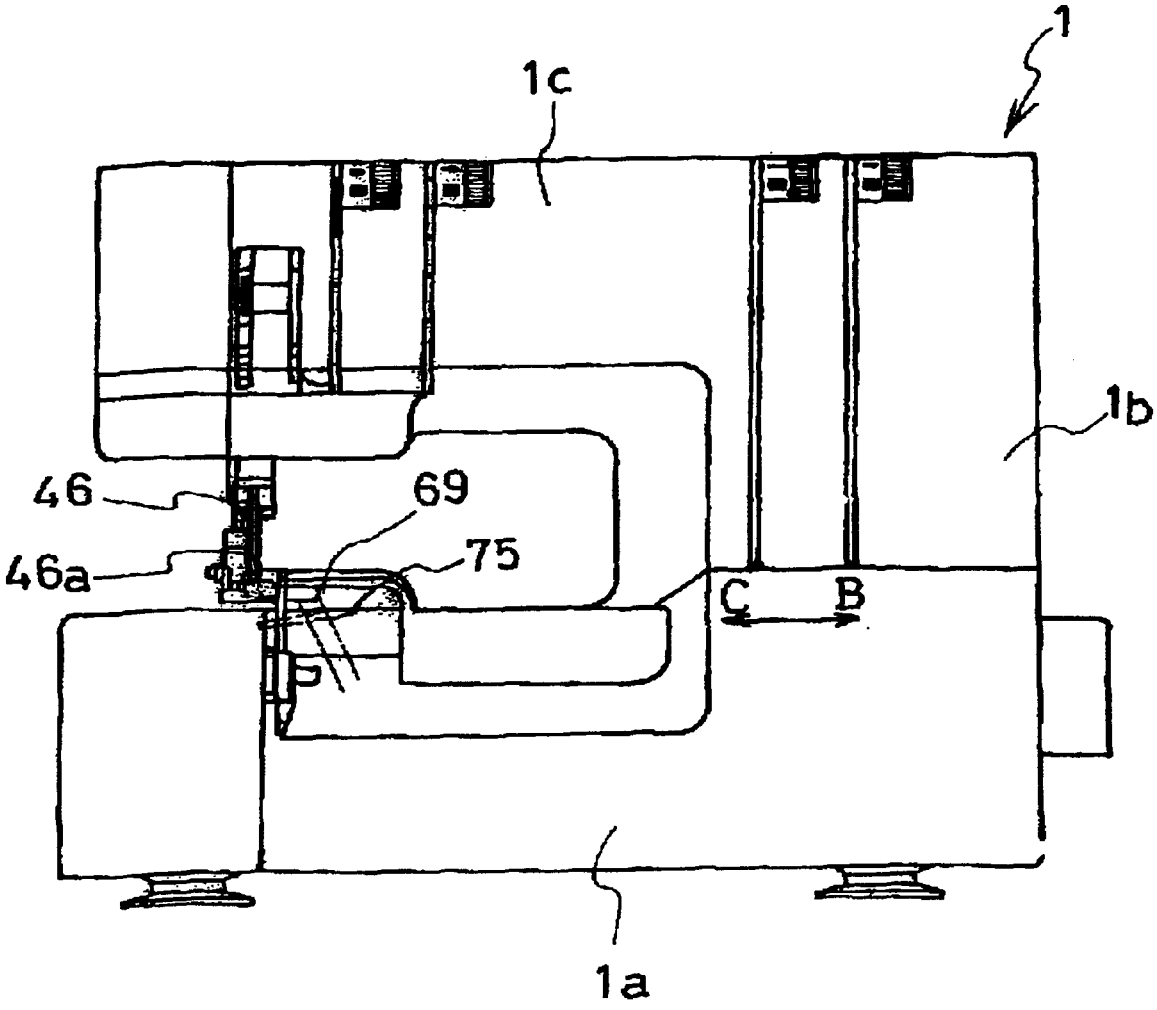
FIG. 1 shows a front view of an over lock sewing machine of an embodiment of the present invention.
Figure 2:
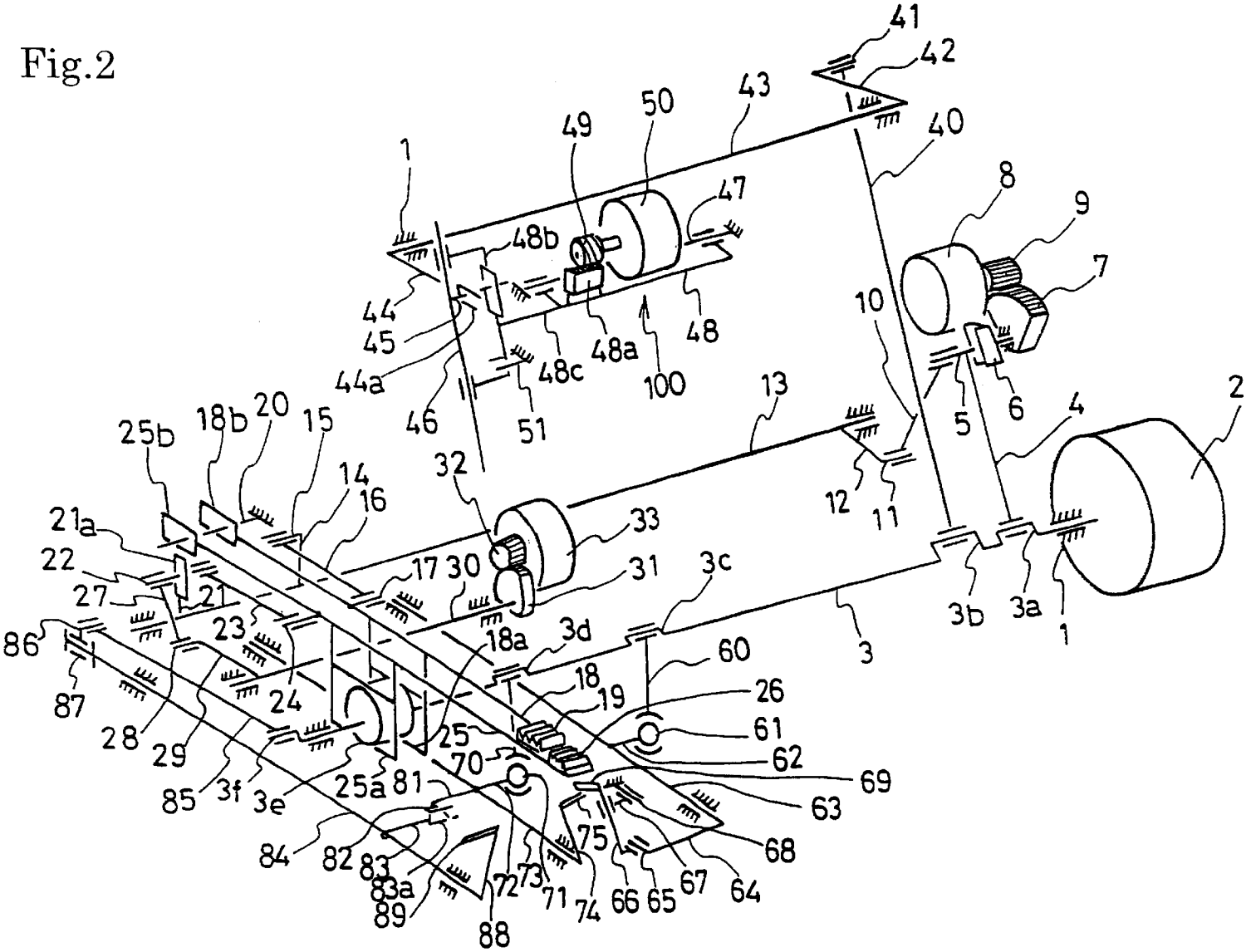
FIG. 2 shows a schematic perspective view of the over lock sewing machine according to the embodiment of the present invention.
Figure 3:
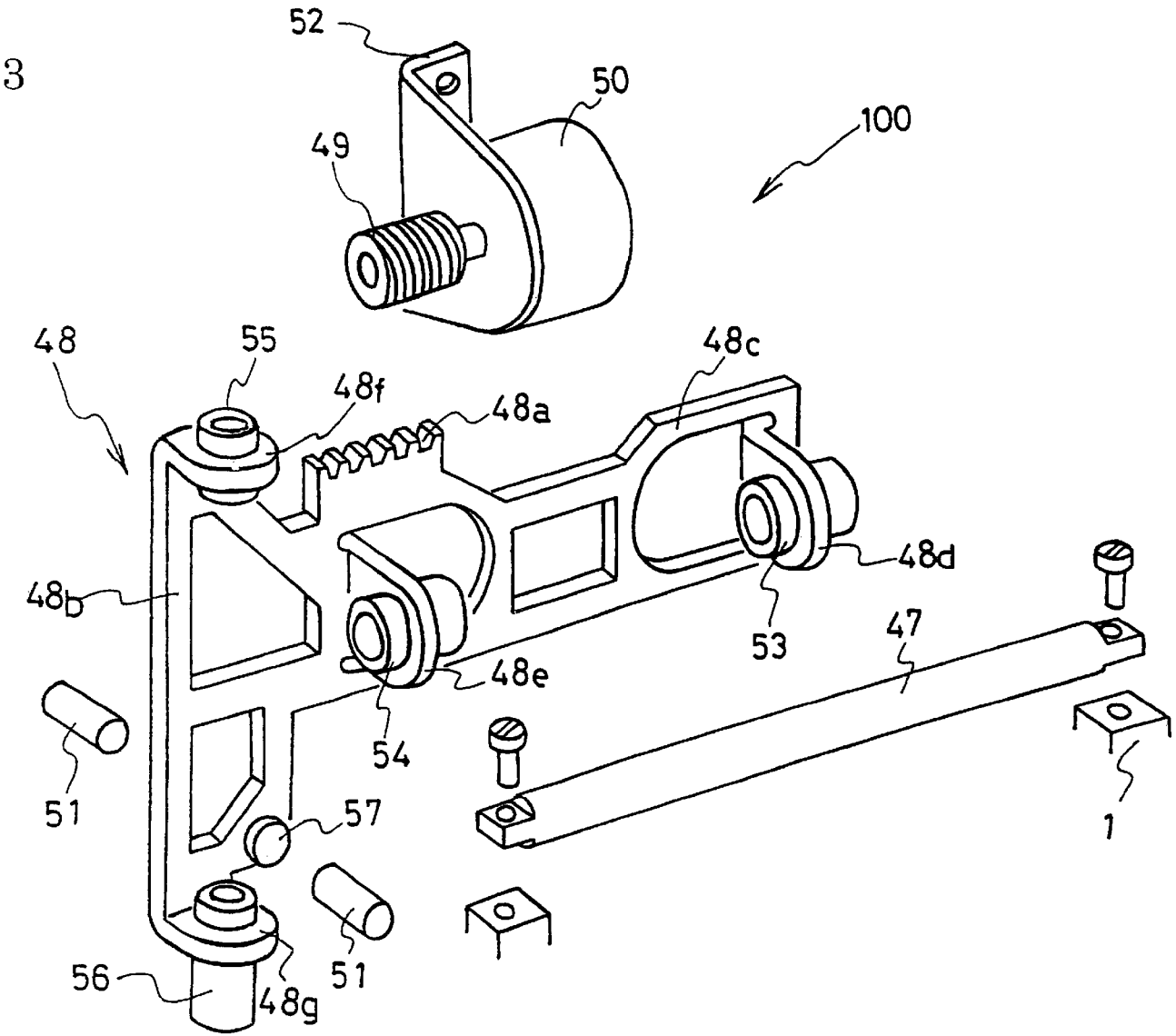
FIG. 3 shows a perspective view of a needle bar transmitting mechanism of the embodiment of the present invention.
Figure 4:
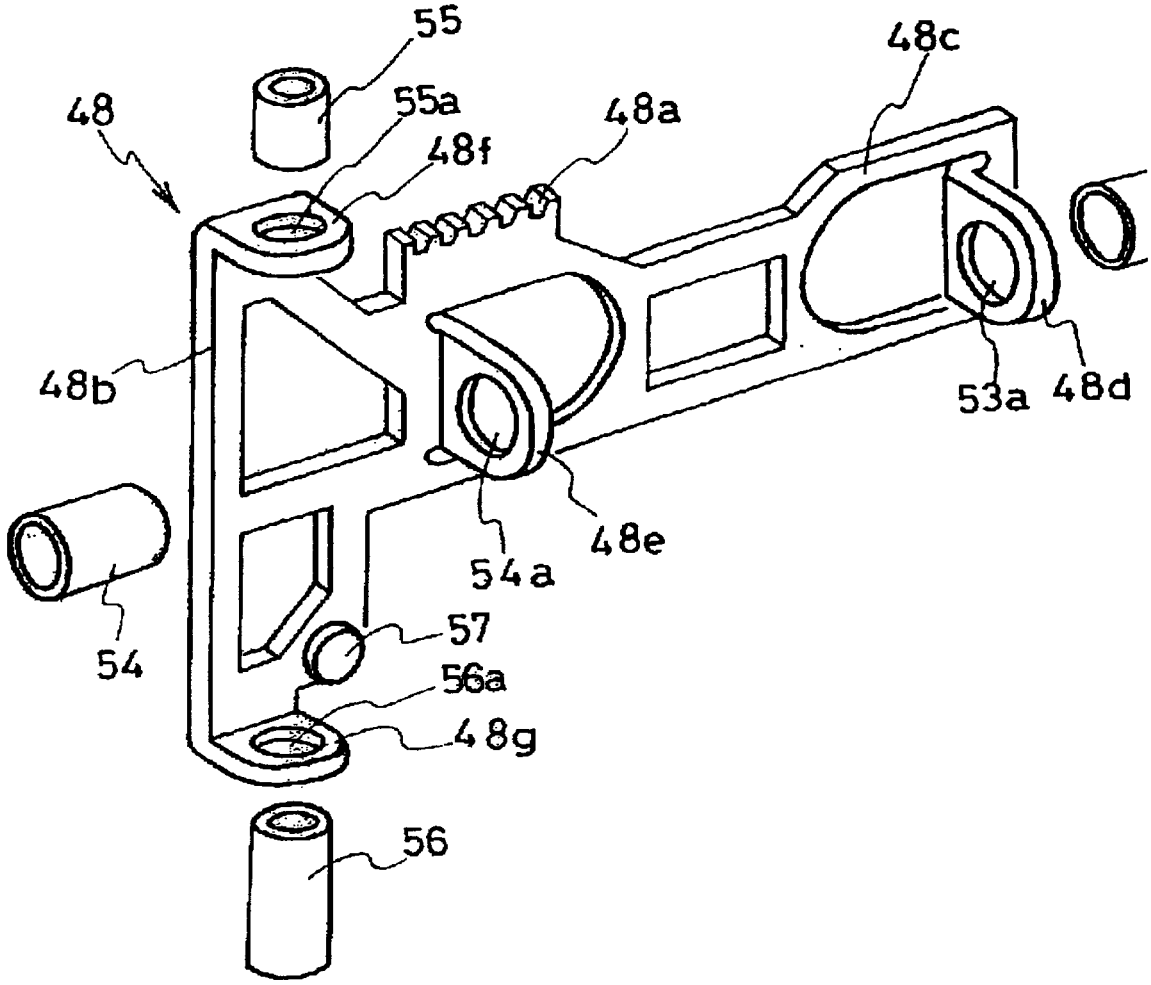
FIG. 4 shows a perspective view of components configuring the needle bar transmitting mechanism of the embodiment.

Referring now to the embodiments of the present invention with reference to the attached drawings, wherein:

FIG. 1 shows a front view of an over lock sewing machine. FIG. 2 shows a schematic perspective view. FIG. 3 shows a perspective view of a needle bar transmitting mechanism 100. FIG. 4 shows a perspective view of components configuring the needle bar transmitting mechanism.

A sewing machine frame 1 of the over lock sewing machine is provided with a bed portion 1*a*, a leg portion 1*b* extending integrally and upwardly from the right side surface of the bed portion 1*a* in FIG. 1, and an arm portion 1*c* extending horizontally from the leg portion 1*b* at the upper of the bed portion 1*a*. A needle bar 46 holding a needle 46*a* is provided on the lower end portion of the arm portion 1*c*. By the vertical reciprocation of the needle bar 46, a seam is formed.

In FIG. 1, when an operator (not shown) is in front of the over lock sewing machine, a work cloth is fed from the near side to the far side. An orthogonality direction to the cloth feeding direction and the vertical reciprocating direction of the needle bar is a right-left direction (B-C direction) in FIG. 1. Hereafter, the direction and the physical relationship are expressed such as the right-left direction, the vertical direction, and the near side as viewed in FIG. 1.

Numeral 3 designates a main shaft firmly arranging drive cams 3*a*, 3*b*, 3*c*, 3*d*, 3*e*, and 3*f* at random position. The main shaft 3 are rotatably supported by the sewing machine frame 1 around both ends. A balance wheel 2 is provided on the right end portion of the main shaft 3.

Numeral 6 designates a feeding adjuster rotatably supported by the sewing machine frame 1. The angle of inclination is changed through a feed regulator worm wheel 7 by a feed regulator pulse motor 8 having a feed regulator worm 9. Accordingly, the rotational movement of the feed rock shaft drive cam 3*a* is converted into the reciprocating rotational movement and adjustably transmitted to a feed shaft 13 rotatably supported by the sewing machine fiche 1 at both ends thereof through a feed drive rod 4, a feed drive rod pin 6, a feed connecting rod 10, a feed drive arm pin 11, and a feed drive arm 12.

A main feed dog 19 is provided on the near side end portion of a main feed bar 18. Horizontal direction guide grooves 18*a*, 18*b* provided in the main feed bar 18 are supported reciprocably in back and forth directions respectively by the feed lifting drive cam 3*e* and a feed bar supporting shaft 20 which is firmly fixed in the sewing machine frame 1 in the right-left horizontal direction. A main feed bar drive arm 14 fixed on the feed shaft 13 reciprocates a main feed bar pin 17 fixed on the main feed bar 18 back and forth though a main feed bar drive arm pin 15 and a main feed bar drive rod 16 Then the main feed dog 19 is moved elliptically by the cooperation of the main feed bar drive arm 14 with the feed lifting drive cam 3*e*.

A differential feed dog 26 is provided on the near side end portion of a differential feed bar 25. Horizontal direction guide grooves 25*a*, 2.5*b* provided in the differential feed bar 25 are supported reciprocably in back and forth directions respectively by the feed lifting drive cam 3*e* and the feed bar supporting shaft 20.

A differential feed bar drive arm 21 fixed on the feed shaft 13 is provided with a guide groove 21*a* extending in radial direction. The differential feed bar drive arm 21 reciprocates a differential feed bar pin 24 fixed on the differential feed bar 25 back and forth through a differential feed bar drive arm pin 22 and a differential feed bar drive rod 23. Then the differential feed dog 26 is moved elliptically by the cooperation of the differential feed bar drive arm 21 with the feed lifting drive cam 3*e*.

Both ends of a differential feed bar regulator shaft 30 are rotatably supported by the sewing machine frame 1. A differential feed regulating worm wheel 31 is fixed on one end of the differential feed bar regulator shaft 30. A worm 32 is fixed integrally on a differential feed regulating pulse motor 33 arranged in the sewing machine frame 1. The rotation of the differential feed bar regulator shaft 30 is adjusted by the engagement of the differential feed regulating worm wheel 31 and the worm 32. A differential feed bar regulating arm 29 is fixed on the other end of the differential feed bar regulator shaft 30. The differential feed bar regulating arm 29 moves and adjusts the differential feed bar drive arm pin 22 along the guide groove 21*a* of the differential feed bar drive arm 21 through a differential feed regulating arm pin 28 and a differential feed regulating link 27. Accordingly, the back and forth reciprocating amount of the differential feed bar 25 is adjusted.

An upper looper arm 64 is fixed on near side end portion of an upper looper drive shaft 63 Both ends of the upper looper drive shaft 63 is rotatably supported by the sewing machine frame 1. An upper looper drive arm 62 forming a ball portion 61 from the center area of the upper looper drive shaft 63 the end portion is provided on the upper looper drive shaft 63. The rotation of the upper looper drive cam 3*c* is converted into the reciprocating rotational movement through an upper looper drive rod 60. An upper looper bar 66 is provided with an upper looper 69 at the upper end portion. The lower end of the upper looper bar 66 is rotatably supported by the upper looper arm pin 65 fixed to the end portion upper looper arm 64. An upper looper oscillating link 67 is supported by an upper looper oscillating link pin 68 as a rotating center firmly fixed to the sewing machine frame 1 at the upper end area. By the engagement of the upper looper bar 66 with the upper looper connecting link 67, an approximately circular movement can be generated at the end portion of the upper looper 69.

Both ends of a lower looper drive shaft 73 are rotatably supported by the sewing machine frame 1. A lower looper arm 74 providing a lower looper 75 at an open end portion is fixed to the near side end portion of the lower looper drive shaft 73. A lower looper drive arm 72 forming a hall portion 71 from the center area of the lower looper drive shaft 73 to the end portion is provided on the lower looper drive shaft 73. The rotation of the lower looper drive cam 3*d* is converted into the reciprocating rotational movement through a lower looper drive rod 70.

Both ends of an annular looper drive shaft 84 are rotatably supported by the sewing machine frame 1. An annular looper arm 88 providing an annular looper 89 at an open end portion is fixed to the near side end portion of the annular looper drive shaft 84. The annular looper drive shaft 84 is provided with an annular looper driven arm 83 forming a divided guide portion 83*a* from the center area of the annular looper drive shaft 84 to the end portion. An annular looper drive arm pin 82 is fixed to an annular looper drive arm 81 extending from the lower looper drive shaft 73. The annular looper driven arm 83 is engaged with the annular looper drive arm pin 82 for reciprocating rotational movement.

The rotation of the annular looper drive cam 3*f* is converted into an axial movement and transmitted to the annular looper drive shaft 84 through an annular looper drive rod 85, an annular looper connecting arm pin 86, and an annular looper connecting arm 87. The annular looper connecting arm 87 is engaged with the lower end portion of the annular looper drive shaft 84. The movement of the annular looper connecting arm 87 is limited to the rotation. In this manner, the end portion of the annular looper 89 moves in back and forth elliptic path as well as the right-left circular movement.

A needle bar drive shaft 43 is rotatably supported by the sewing machine frame 1. Both ends of the needle bar drive shaft 43 are respectively fixed to a first needle bar drive arm 42 and a second needle bar drive arm 44. The needle bar drive shaft 43 is reciprocably rotated by the rotation of the needle bar drive cam 31*b* through a needle bar drive rod 40 and a needle bar drive pin 41.

A needle bar holder 48 is configured with an approximately vertical portion 48*b* and an approximately horizontal portion 48*c* extending perpendicularly from the middle of the approximately vertical portion 48*b*. At an upper hem of the approximately horizontal portion 48*c*, a rack 48*a* is provided in parallel with the extending direction of the approximately horizontal portion 48*c*. The approximately horizontal portion 48*c* is further provided with boss portions 48*d*, 48*e*. Each boss portion 48*d*, 48*e* is respectively provided with horizontal hole portions, 53*a*, 54*a*. Both horizontal hole portions 53*a*, 54*a* have approximately the same central axis each other which is in parallel with the extending direction of the approximately horizontal portion 48*c*.

Boss portions 48*f*, 48*g* are provided on both end areas of the approximately vertical portion 48*b*. Each boss portion 48*f*, 48*g* is respectively provided with vertical hole portions 55*a*, 56*a*. Both vertical hole portions 55*a*, 56*a* are provided in order to have approximately the same central axis, each other in vertical direction.

Guide shaft bushes 53, 54 are respectively inserted into the horizontal hole portions 53*a*, 54*a* and fixed by the adhesive material. Needle bar bushes 55, 56 are respectively inserted into the vertical hole portions 55*a*, 56*a* and fixed by the adhesive material. The guide shaft bushes 53, 54 and the needle bar bushes 55, 56 are fixed with keeping the perpendicularity between the central axis of the guide shaft bushes 53, 54 and the central axis of the needle bar bushes 55, 56 by a regular tool (not shown). Accordingly, the needle bar holder 48 is manufactured by the press molding. However, since the press molding accuracy is not needed, the needle bar holder 48 can be manufactured at A low cost.

A guide shaft 47 is inserted into the guide shaft bushes 53, 54 and both end portions thereof are fixed to the sewing machine frame 1 by bolts. Accordingly, the needle bar holder 48 is slidably supported by the guide shaft 47. A needle bar 46 is inserted into the needle bar bushes 55, 56.

A needle bar holder drive pulse motor 50 as a rotating mans is fixed to the sewing machine frame 1 through a holder 52. A worm 49 connected with the needle bar holder drive pulse motor 50 is in meshing engagement with the rack 48*a*. The needle bar transmitting mechanism 100 is configured with the guide shaft 47, the needle bar holder 48, the rack 48*a*, the worm 49, and the needle bar holder drive pulse motor 50.

A needle bar holder guide 51 provided in the sewing machine frame 1 restricts the moving direction of the needle bar 46 to the appropriate angle. A divided guide portion 44*a* is formed on the end portion of the second needle bar drive arm 44. The divided guide portion 44*a* is engaged with a needle bar holder 45 fixed to the needle bar 46 and transmits the vertical reciprocating movement to the needle bar 46. According to these structure, the needle always moves perpendicularly. As a result, even when a thick cloth is sewn, any defect such as a stitch skipping or a thread breakage caused by a needle bend can be prevented.

Nextly, the operation of above described structure will be explained.

The main feeding is operated as follows. The feed rock shaft drive cam 3*a* integrally rotating with the main shaft 3 rotated by a driving motor (not shown) transmits the reciprocating rotation to the feed shaft 13 through the feed drive rod pin 5 engaging with the feeding adjuster 6, the feed connecting rod 10, and the feed drive arm 12. The reciprocating rotation, amount is freely adjusted by the feeding adjuster 6. The feeding adjuster 6 is set to the appropriate angle by the feed regulator pulse motor 8 which is controlled its rotation by a control circuit (not shown). The main feed bar drive arm 14 oscillating integrally with the feed shaft 13 moves the main feed bar 18 back and forth through the main feed bar drive rod 16. By the cooperation of the main feed bar drive arm 14 with the feed lifting drive cam 3*e*, the main feed dog 19 move, in the elliptic path.

The differential feeding is operated as follows. The differential feed bar drive arm 21 oscillating integrally with the feed shaft 13 moves the differential feed bar 25 back and forth through the differential feed bar drive arm pin 22 and the differential feed bar drive rod 23. By the cooperation of the differential feed bar drive arm 21 with the feed lifting drive cam 3*e*, the differential feed dog 26 moves in the elliptic path. The horizontal moving amount of the elliptic path is adjusted by freely adjusting the radial direction length of the differential feed bar drive arm pin 22 from the center of the feed shaft 13. The adjustment is achieved through the differential feed bar regulator shaft 30 adjustably rotated with the appropriate angle by the differential feed regulating pulse motor 33 controlled by a control circuit, the differential feed bar regulating arm 29, and the differential feed regulating link 27. By the cooperation of the main feeding with the differential feeding, a cloth feeding of a work cloth can be achieved.

The upper looper is operated as follows. The rotating movement of the upper looper drive cam 3*c* integrally rotating with the main shaft 3 is transmitted to the upper looper drive shaft 63 as a reciprocating rotation through the upper looper drive rod 60 and the upper looper drive arm 62. By the cooperation of the tipper looper arm 64 oscillating integrally with the upper looper drive shaft 63 with the upper looper oscillating link 67, the upper looper 69 provided on the upper end portion of the upper looper bar 66 moves in the approximately circular path.

The lower looper is operated as follows. The rotating movement of the lower looper drive cam 3*d* integrally rotating with the main shaft 3 is transmitted to the lower looper drive shaft 73 as a reciprocating rotation through the lower looper drive rod 70 and the lower looper drive arm. 72. The lower looper 75 provided on the upper end portion of the lower looper arm 74 oscillating integrally with the lower looper drive shaft 73 moves in the circular path.

The annular looper is operated as follows. By the annular looper drive arm 81 oscillating integrally with the lower looper drive shaft 73, the reciprocating rotation is transmitted to the annular looper shaft 84 through the annular looper driven arm 83. The rotation of the annular looper drive cam 9*f* is combined with the reciprocated movement in axial direction operated through the annular looper drive rod 85 and the annular looper connecting arm 87. Accordingly, the end portion of the annular looper 89 moves in back and forth elliptic path as well as the right-left circular movement.

The needle bar is operated as follows. The rotating movement of the needle bar drive cam 3*b* integrally rotating with the main shaft 3 transmits the vertical reciprocating movement to the needle bar 46 through the needle bar rod 40, the first needle bar drive arm 42, the needle bar drive shaft 43, and the second needle bar drive arm 44. The needle bar holder 48 moves appropriately right and left being synchronized with the moving period of the loopers through the worm 49, the rack 48*a* by the needle bar holder drive pulse motor 50 controlled by a control circuit.

Figure 5:
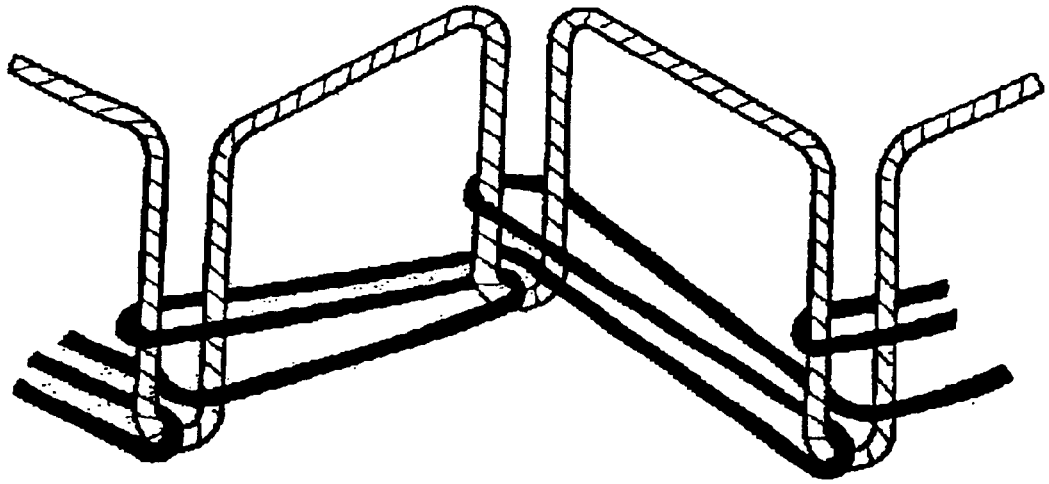
FIG. 5 shows a seam of a double-thread chain zigzag stitch by one needle and two threads.
Figure 6:
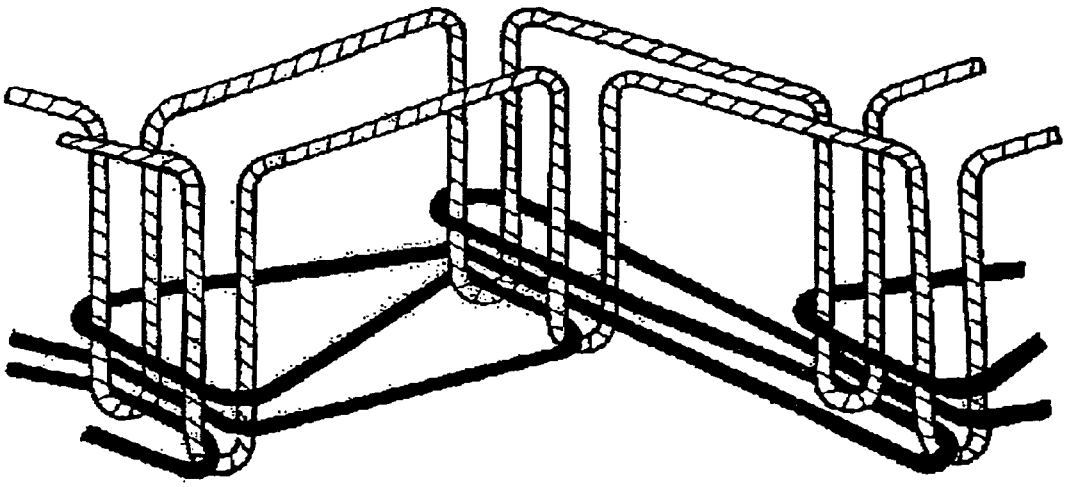
FIG. 6 shows a seam of a double-thread chain zigzag stitch by two needles and three threads.
Figure 7A:
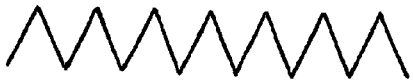
FIG. 7 shows various seams realized by the embodiment of the present invention.
Figure 7B:
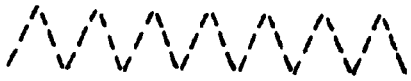
Figure 7C:
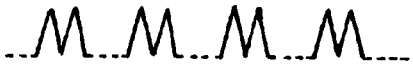
Figure 7D:
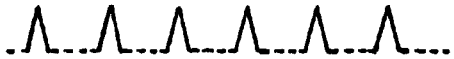
Figure 7E:
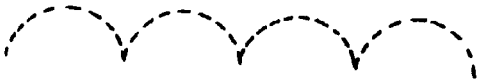
Figure 7F:
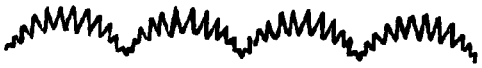
Figure 7G:
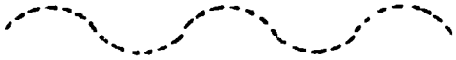
Figure 7H:
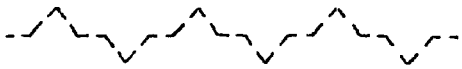
Figure 7I:
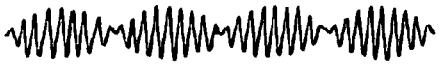
Figure 7J:
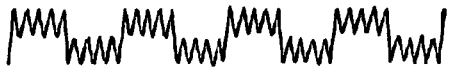
Figure 7K:
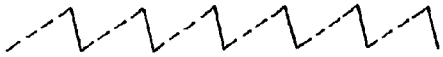
Figure 7M:
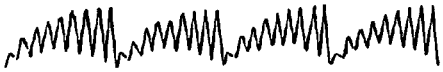
Figure 7N:
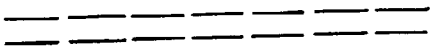
Figure 7O:
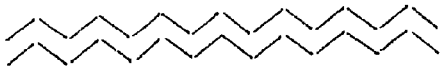
Figure 7P:
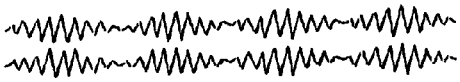
Figure 8:
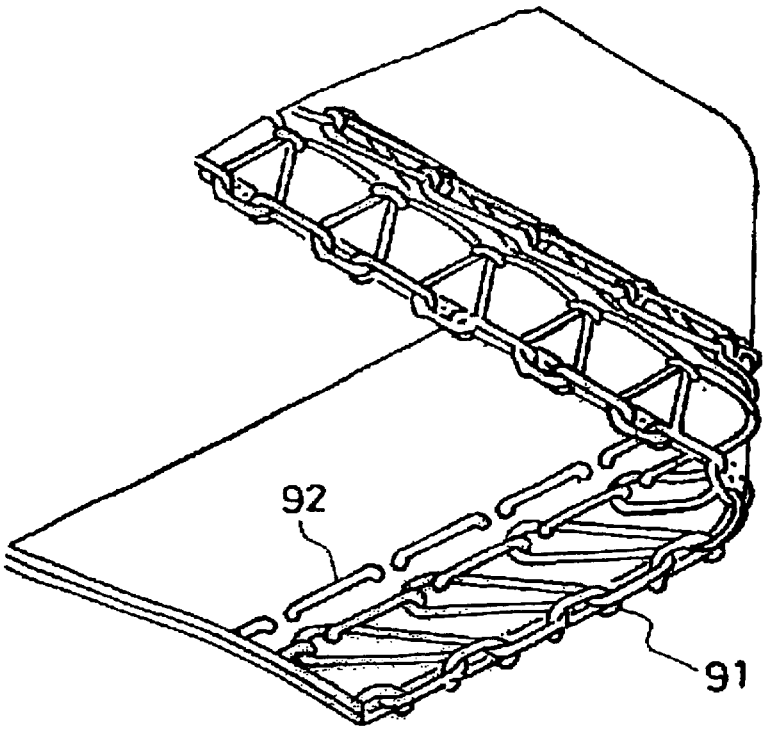
FIG. 8 shows a partial perspective view of a cloth sewed with a safety stitch according to the embodiment of the present invention.
Figure 9:
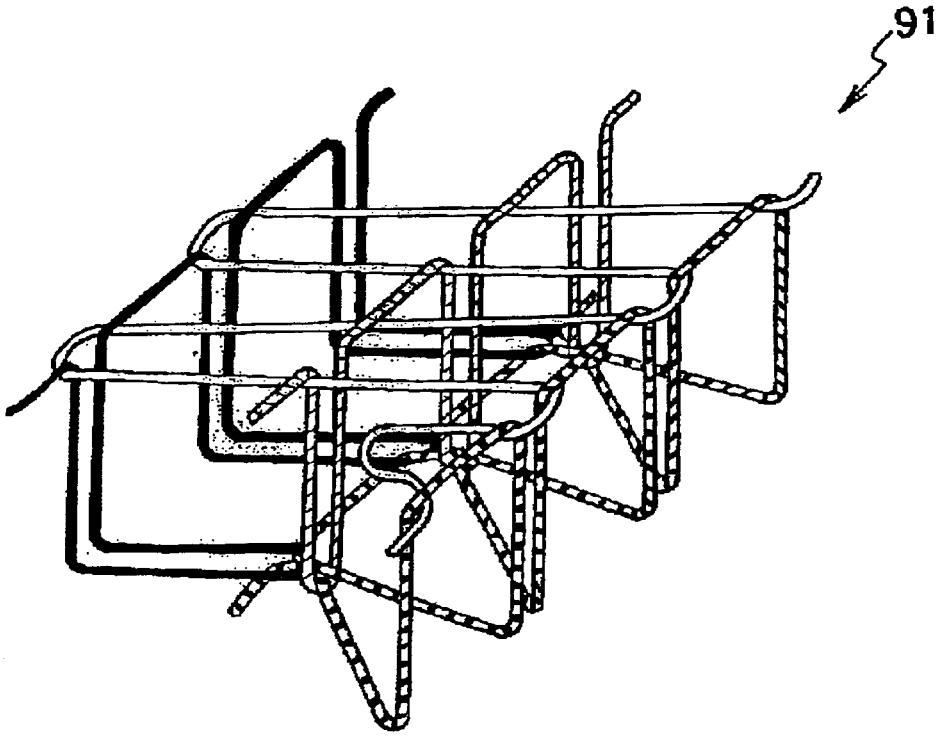
FIG. 9 shows a seam of an over-edge chain stitch by two needles and four threads according to the embodiment of the present invention.
Figure 10:
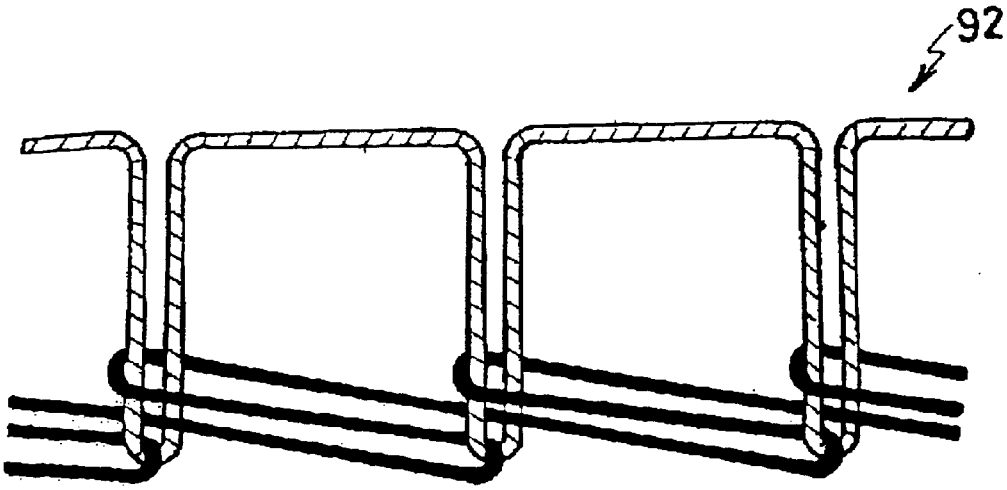
FIG. 10 shows a seam of a double-thread chain straight stitch by one needle and two threads according to the embodiment of the present invention.
Figure 11A:
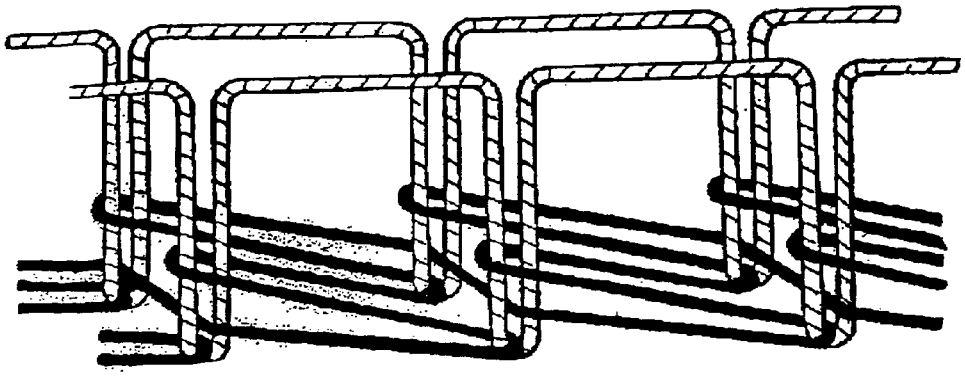
FIG. 11(*a*) shows a seam of a double-thread chain straight stitch by two needles and three threads according to the embodiment of the present invention, and FIG. 11(*b*) shows a seam of a double-thread chain straight stitch by three needles and four threads according to the embodiment of the present invention.
Figure 11B:
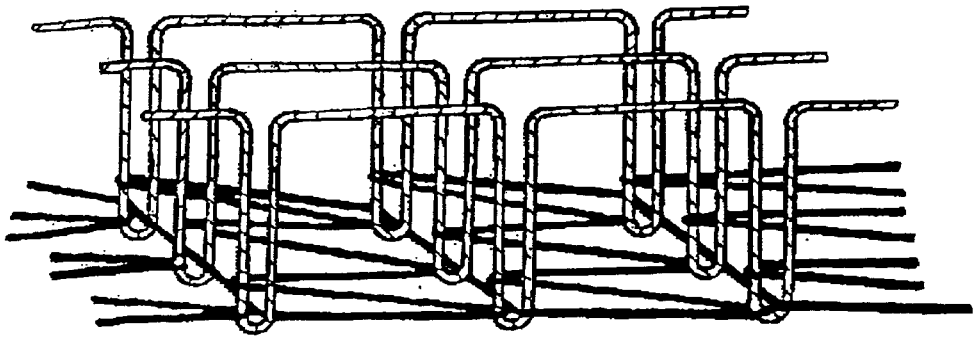

According to the operation of these structure, various sewing can he realized. FIG. 5 shows a seam of a double-thread chain zigzag stitch by one needle and two threads. FIG. 6 shows a seam of a double-thread chain zigzag stitch by using two needles and three threads. FIG. 7 shows various seams realized by the embodiment of the present invention. FIG. 8 shows a partial perspective view of a cloth sewed with a safety stitch. Number 91 shows a seam of an over-edge chain stitch. Number 9 shows a seam of a double-thread chain straight stitch. FIG. 9 shows a scam of an over-edge chain stitch by two needles and four threads. FIG. 10 shows a seam of a double-thread chain straight stitch by one needle and two threads. FIG. 11 shows a seam of a double-thread chain straight stitch. FIG. 11(*a*) shows a seam of a double-thread chain straight stitch by two needles and three threads, and FIG. 11(*b*) shows a seam of a double-thread chain straight stitch by three needles and four threads The over-edge chain stitch as shown in FIG. 9 is carried out by the operation of the over-edge chain needle among a plurality of needles provided at the lower end of the needle bar 46, the lower looper 75, and the upper looper 69. The seam of a double-thread chain straight stitch as shown in FIGS. 1, 11 is carried out by the operation of the double-thread chain stitch needle among the plurality of needles provided at the lower end of the needle bar 46 and the annular looper 89. In this case, the needle bar holder drive pule motor 50 is stopped at the basic position. The double-thread chain straight stitch can substitute for a lock stitch of a lock stitch sewing machine. The safety stitch as shown in FIG. 8 is carried out by the synchronized operation of the over-edge chain stitch and the double-thread chain straight stitch.

The double-thread chain zigzag stitch as shown in FIGS. 5, 6 is carried out by the operation of the double-thread chain stitch needle among the plurality of needles provided at the lower end of the needle bar 46 and the annular looper 89. In this case, the needle bar holder drive pulse motor 50 is synchronized with the moving period of the loopers with a half period by a control circuit. Then the needle bar holder drive pulse motor 50 rotates with an freely angle and moves the needle bar 46 right and left.

The double-thread chain zigzag decorative stitch is carried out by the operation of the double-thread chain stitch needle among the plurality of needles provided at the lower end of the needle bar 46 and the annular looper 89. In this case, the needle bar holder drive pulse motor 50 is synchronized with the moving period of the loopers with a half period by a control circuit.

Then the needle bar holder drive pulse motor 50 rotates with an appropriate angle by every stitch and moves the needle bar 46 right and left.

The over-edge chain stitch and the double-thread chain straight stitch as; shown in FIGS. 8 through 11 can be sewn by a conventional over lock sewing machine. However, in the over lock sewing machine of this invention, the double-thread chain zigzag stitch can be made as well as the over-edge chain stitch and the double-thread chain straight stitch. The double-thread chain stitch can substitute for a lock stitch of a lock stitch sewing machine. As a result, various sewing pattern as shown in FIG. 7 can be realized by one over lock sewing machine.

In this invention, only the needle bar transmitting mechanisms 47 through 50 are added. A sewing machine which can make a sewing pattern by a pseudo lock stitch sewing machine and an over lock sewing machine can be realized at a low cost. Moreover, besides the needles necessary for forming each seam, the loopers, the needle thread take ups, and the thread guide members, the appearance of the structure of the over lock sewing machine of this invention is totally the same as the conventional over lock sewing machine. The over lock sewing machine is capable with operation as well as the conventional one.

In this embodiment, the needle bar holder drive pulse motor 50 is used as a rotating means. Any rotating means which can control the rotating angle can be used. As for the needle bar transmitting mechanism 100, the structure is net limited to this embodiment. Any mechanism which can move the needle bar right and left in approximately orthogonality direction to the cloth feeding direction and the vertical reciprocating direction of the needle bar can be used. This needle bar transmitting mechanism is not limited to the mechanism which moves the needle bar in parallel. For instance, a pendulum typed right-left oscillating mechanism can be used.

The over lock sewing machine for forming seams of an over-edge chain stitch and a double-thread chain stitch on a work cloth is provided with a needle bar holding a plurality of needles for forming a seam by a vertical reciprocating movement a plurality of loopers and a needle bar transmitting mechanism moving the needle bar in approximately orthogonal direction relative to a cloth feeding direction of the work cloth and the vertical reciprocating direction of the needle bar. Accordingly, the over lock sewing machine can make various decorative stitches with an over-edge chain stitch function and a zigzag stitch function. Moreover, the over lock sewing machine is capable with operation at a low cost.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. An over lock sewing machine for forming seams of an over-edge chain stitch and a double-thread chain stitch on a work cloth, comprising:

a needle bar holding a plurality of needles for forming a seam by a vertical reciprocating movement;

a plurality of loopers; and a needle bar transmitting mechanism moving the needle bar in an approximately orthogonal direction relative to a cloth feeding direction of the work cloth and the vertical reciprocating direction of the needle bar.

2. An over lock sewing machine as defined in claim 1, wherein the needle bar transmitting mechanism is comprised of an approximately T shaped needle bar holder having an approximately vertical portion vertically reciprocably supporting the needle bar at both end areas and an approximately horizontal portion extending perpendicularly from the middle of the vertical portion, a rack provided in parallel with the extending direction of the horizontal portion, and a worm connected with a rotating drive device fixed to a sewing machine frame and being in meshing engagement with the rack.

3. An over lock sewing machine as defined in claim 2, wherein the approximately horizontal portion is provided with a holding device being in parallel with the moving direction of the needle bar by the needle bar transmitting mechanism for slidably supporting a guide shaft fixed to the sewing machine frame at both end areas of the guide shaft.

4. An over lock sewing machine as defined in claim 3, wherein the holding device includes a plurality of boss portions extending from the both end areas of the horizontal portion and having a corresponding number of horizontal holes each having a common central axis extending in horizontally extended direction of the horizontal portion, a corresponding number of bushes for the guide shaft inserted into the horizontal holes, and the guide shaft supported by the bushed, said holding device further includes a plurality of boss portions extending from the both end areas of the vertical portion and having a corresponding number of vertical holes each having a common central axis extending in vertically extended direction of the vertical portion, a corresponding number of bushes for the needle bar inserted into the vertical holes, and the needle bar vertically reciprocably supported by the bushes for the needle bar, and wherein the horizontal holes and the bushes for the guide shaft are adhered together and the vertical holes and the bushes for the needle bar are adhered together.

5. An over lock sewing machine for forming seams of an over-edge chain stitch and a double-thread chain stitch on a work cloth, comprising:

a needle bar holding a plurality of needles for forming a seam by a vertical reciprocating movement;

a plurality of loopers; and needle bar transmitting means for moving, in synchronization with looper motion, the needle bar in an approximately orthogonal direction relative to a cloth feeding direction of the work cloth and the vertical reciprocating direction of the needle bar.

* * * * *